US009138019B2

(12) United States Patent
Curtis

(10) Patent No.: US 9,138,019 B2
(45) Date of Patent: Sep. 22, 2015

(54) PROTECTIVE GARMENT WITH ELASTIC THERMAL BARRIER PORTIONS

(75) Inventor: Nicholas J. Curtis, Liberty Township, OH (US)

(73) Assignee: LION GROUP, INC., Dayton, OH (US)

( * ) Notice: Subject to any disclaimer, the term of this patent is extended or adjusted under 35 U.S.C. 154(b) by 247 days.

(21) Appl. No.: 13/567,276

(22) Filed: Aug. 6, 2012

(65) Prior Publication Data

US 2014/0033410 A1 Feb. 6, 2014

(51) Int. Cl.
*A41D 13/00* (2006.01)
*A62B 17/00* (2006.01)

(52) U.S. Cl.
CPC ..... *A41D 13/0002* (2013.01); *A41D 2300/22* (2013.01); *A62B 17/003* (2013.01)

(58) Field of Classification Search
CPC ..... A41D 1/00; A41D 1/02; A41D 1/04; A41D 1/20; A41D 3/00; A41D 3/02; A41D 13/00; A41D 13/0005; A41D 13/0015; A41D 13/12; A41D 13/1209; A41D 27/02; A41D 31/00; A41D 31/0022; A41D 13/0027; A41D 31/0033; A41D 31/00381; A41D 31/02; A41D 2300/00; A41D 2300/20; A41D 2300/22; A41D 2300/24; A41D 240/10; A41D 2600/20
USPC ..... 450/97, 85, 87, 93, 30–33, 64–66; 2/97, 2/85, 87, 93, 108, DIG. 4, 69
See application file for complete search history.

(56) References Cited

U.S. PATENT DOCUMENTS

| | | | | | |
|---|---|---|---|---|---|
| 2,252,234 | A | * | 8/1941 | Siegel | 2/93 |
| 3,056,411 | A | * | 10/1962 | Child | 450/65 |
| 3,086,214 | A | | 4/1963 | Lash | |
| 3,320,969 | A | * | 5/1967 | Gordon | 376/256 |
| 4,670,913 | A | | 6/1987 | Morell et al. | |
| 4,922,552 | A | * | 5/1990 | Grilliot et al. | 2/93 |
| 5,033,986 | A | * | 7/1991 | Feigenbaum et al. | 450/30 |
| 5,167,566 | A | * | 12/1992 | Novitsky et al. | 450/74 |
| 5,527,597 | A | | 6/1996 | Stanhope et al. | |
| RE35,436 | E | | 2/1997 | Grilliot et al. | |
| 5,694,981 | A | | 12/1997 | Stanhope et al. | |
| 5,720,045 | A | * | 2/1998 | Aldridge | 2/81 |
| 5,727,401 | A | | 3/1998 | Statham et al. | |
| 5,819,316 | A | * | 10/1998 | Aldridge | 2/81 |

(Continued)

FOREIGN PATENT DOCUMENTS

| | | |
|---|---|---|
| GB | 2043430 | 2/1980 |
| RU | 2374959 | 10/2009 |

(Continued)

OTHER PUBLICATIONS

International Search Report and Written Opinion, PCT/US2013/053122. (Aug. 1, 2013).

*Primary Examiner* — Gloria Hale
(74) *Attorney, Agent, or Firm* — Thompson Hine LLP

(57) ABSTRACT

A protective garment including an outer shell and a thermal barrier positioned inside the outer shell such that the thermal barrier is configured to be positioned between the outer shell and a wearer when the garment is worn. The thermal barrier includes at least two areas of elastic material, each elastic area having directional stretch qualities such that each elastic area has greater elasticity in an associated particular direction than in other directions, and wherein said particular directions for said at least two elastic areas are not parallel.

32 Claims, 5 Drawing Sheets

(56) References Cited

U.S. PATENT DOCUMENTS

| | | | | |
|---|---|---|---|---|
| 5,860,163 | A * | 1/1999 | Aldridge | 2/81 |
| 5,920,905 | A * | 7/1999 | Aldridge | 2/81 |
| 6,687,913 | B2 * | 2/2004 | Aldridge | 2/81 |
| 6,691,317 | B2 * | 2/2004 | Cochran | 2/97 |
| 6,790,122 | B2 * | 9/2004 | Mitchell et al. | 450/66 |
| 6,799,331 | B2 | 10/2004 | Griesbach, III et al. | |
| 6,918,812 | B2 * | 7/2005 | Giese | 450/65 |
| 6,978,481 | B2 * | 12/2005 | Mordecai et al. | 2/81 |
| 7,013,488 | B2 | 3/2006 | Lewis et al. | |
| 7,186,163 | B2 * | 3/2007 | Carlucci | 450/28 |
| 7,543,338 | B2 * | 6/2009 | Culhane | 2/93 |
| 7,707,658 | B2 | 5/2010 | Culhane | |
| 8,403,724 | B1 * | 3/2013 | Chapin | 450/32 |
| 2003/0082994 | A1 * | 5/2003 | Mitchell et al. | 450/74 |
| 2004/0137822 | A1 * | 7/2004 | Mitchell | 450/75 |
| 2006/0105658 | A1 | 5/2006 | Patz et al. | |
| 2009/0255031 | A1 | 10/2009 | McIntosh et al. | |

FOREIGN PATENT DOCUMENTS

| | | |
|---|---|---|
| RU | 2422058 | 6/2011 |
| WO | 99/00029 | 1/1999 |
| WO | 2008/125993 | 10/2008 |

* cited by examiner

PROTECTIVE GARMENT WITH ELASTIC THERMAL BARRIER PORTIONS

The present invention relates to protective garments, and more particularly, to protective garments including a thermal barrier incorporating stretchable or elastic materials.

BACKGROUND

Protective or hazardous duty garments are used in a variety of industries and settings to protect the wearer from hazardous conditions such as heat, smoke, cold, sharp objects, chemicals, liquids, fumes and the like. Such protective or hazardous duty garments are often used in adverse conditions, such as in the presence of high heat or flames, or exposure to smoke or chemicals and the like. In addition, the wearers of such garments are typically placed under physical strain by carrying heavy gear and equipment, and carrying out strenuous tasks. Wearers seek to avoid fatigue to remain mentally sharp and physically ready to carry out tasks.

SUMMARY

In one embodiment, the invention is a protective garment including stretchable or elastic materials which provide ease of movement to the wearer. More particularly, in one embodiment the invention is a protective garment including an outer shell and a thermal barrier positioned inside the outer shell such that the thermal barrier is configured to be positioned between the outer shell and a wearer when the garment is worn. The thermal barrier includes at least two areas of elastic material, each elastic area having directional stretch qualities such that each elastic area has greater elasticity in an associated particular direction than in other directions, and wherein said particular directions for said at least two elastic areas are not parallel.

DETAILED DESCRIPTION

Figure 1:
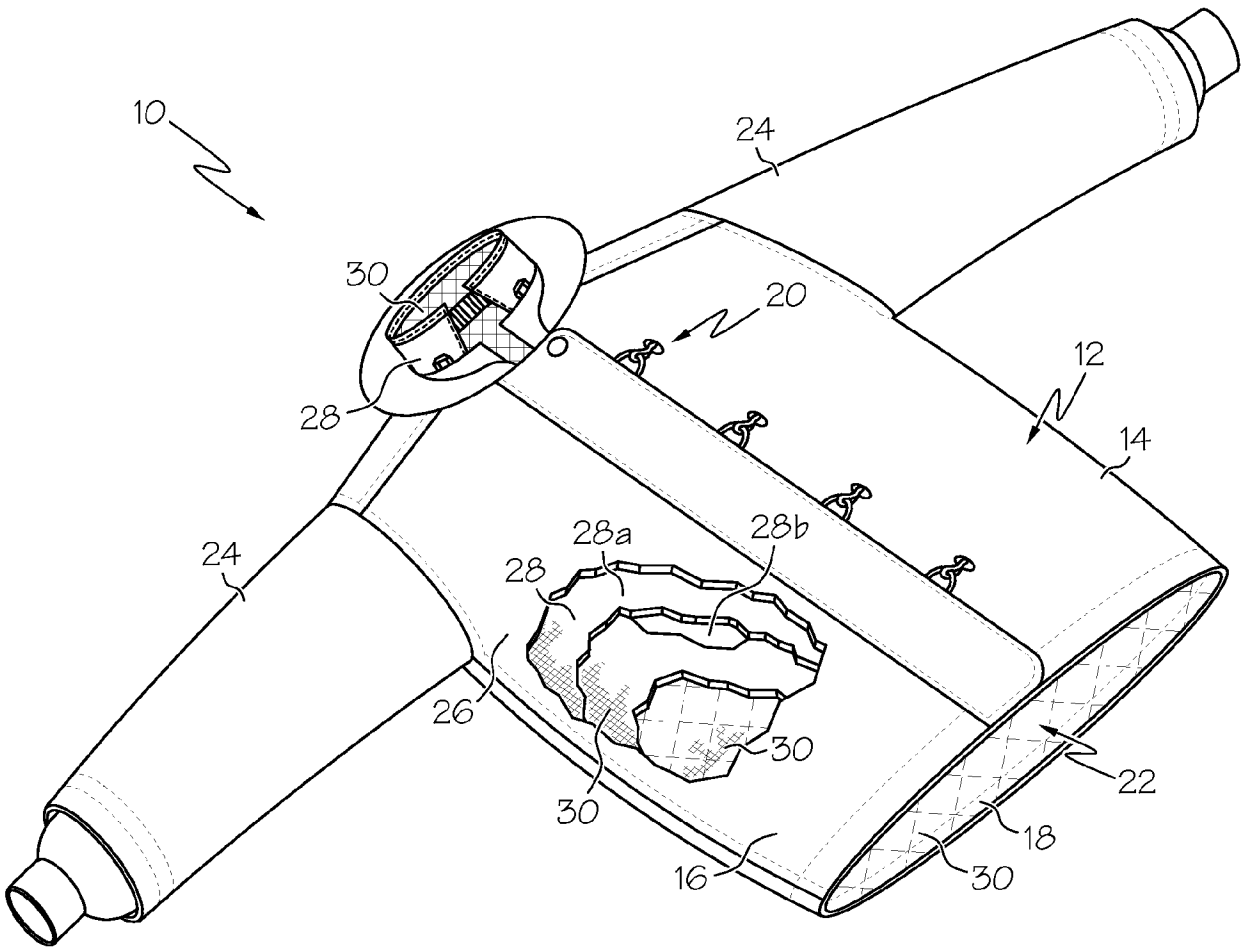
FIG. 1 is front perspective view of one embodiment of the garment of the present invention, with portions of various layers cut away for illustrative purposes.

FIG. 1 illustrates a protective or hazardous duty garment in the form of a firefighter's coat, generally designated 10. The coat 10 may include a body portion 12 having a left front panel 14, right front panel 16 and a back panel 18. The left front panel 14 and right front panel 16 may be releasably attachable by a fastener 20, such as a zipper, snaps, clasps, clips, hook-and-loop fastening material (i.e., VELCRO® fastening material), combinations of these components or the like. The body portion 12 may define a torso cavity 22 that is shaped and configured to receive a wearer's torso therein. The garment 10 may include a pair of sleeves 24 coupled to and extending generally outwardly from the body portion 12 and shaped to receive a wearer's arms therein.

The garment 10 may include various layers through its thickness to provide various heat, moisture and abrasion resistant qualities to the garment 10 so that the garment 10 can be used as a protective, hazardous duty, and/or firefighter garment. For example, the garment 10 may include an outer shell 26, a moisture barrier 28 located inside of and adjacent to the outer shell 26, and a thermal liner or barrier 30 located inside of and adjacent to the moisture barrier 28.

The outer shell 26 may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc. of Wilmington, Del.), and commercially available polybenzamidazole fibers include PBI fibers (a trademark of PBI Performance Fabrics of Charlotte, N.C.). Thus, the outer shell 26 may be an aramid material, a blend of aramid materials, a polybenzamidazole material, a blend of aramid and polybenzamidazole materials, or other appropriate materials. The outer shell 26 can also be made of a thermostable organic polymer material, such as KERMEL® material sold by Kermel SAS of Colmar, France.

If desired, the outer shell 26 may be coated with a polymer, such as a durable, water repellent finish (i.e. a perfluorohydrocarbon finish, such as TEFLON® finish sold by E. I. Du Pont de Nemours and Company of Wilmington, Del.). The materials of the outer shell 26 may have a weight of, for example, between about five and about ten oz./yd$^2$.

The moisture barrier 28 and thermal barrier 30 may be generally coextensive with the outer shell 26 to provide moisture and thermal protection throughout the garment 10. The moisture barrier 28 may include a semi-permeable membrane layer 28*a* and a substrate 28*b*. The membrane layer 28*a* may be generally water or moisture vapor permeable but generally impermeable to liquid moisture. The membrane layer 28*a* may be made of or include expanded polytetrafluoroethylene ("PTFE") such as GORE-TEX or CROSSTECH materials (both of which are trademarks of W.L. Gore & Associates, Inc. of Newark, Del.), polyurethane-based materials, neoprene-based materials, cross-linked polymers, polyamid, or other materials. The membrane layer 28*a* may have microscopic openings that permit moisture vapor (such as water vapor) to pass therethrough, but block liquids (such as liquid water) from passing therethrough. The membrane layer 28*a* may be made of a microporous material that is either hydrophilic, hydrophobic, or somewhere in between. The membrane layer 28*a* may also be monolithic and may allow moisture vapor transmission therethrough by molecular diffusion. The membrane layer 28*a* may also be a combination of microporous and monolithic materials (known as a bicomponent moisture barrier), in which the microporous or monolithic materials are layered or intertwined.

The membrane layer 28*a* may be bonded or adhered to a substrate 28*b* of a flame and heat resistant material to provide structure and protection to the membrane layer 28*a*. The substrate 28*b* may be or include aramid fibers similar to the aramid fibers of the outer shell 26, but may be thinner and lighter in weight. The substrate 28*b* may be woven, nonwoven, spunlace or other materials. In the illustrated embodiment, the membrane layer 28*a* is located between the outer shell 26 and the substrate 28*b*. However, the orientation of the moisture barrier 28 may be reversed such that the substrate 28*b* is located between the outer shell 26 and the membrane layer 28*a*.

The thermal barrier 30 may be made of nearly any suitable flame resistant material that provides sufficient thermal insulation, including materials described in greater detail below. In one embodiment, the thermal barrier 30 (or the garment 10 as a whole) may be made of a material that has sufficient loft/bulk to trap air therein to increase the thermal protection. The thermal barrier 30 have a thermal protection performance ("TPP") of at least about twenty, and the garment 10 as a whole may have a TPP of at least about thirty-five, although the TPP values can vary. If desired, the thermal barrier 30 may be treated with a water-resistant or water-repellent finish.

Although the moisture barrier 28 is shown as being located between the outer shell 26 and the thermal barrier 30, the positions of the moisture barrier 28 and thermal barrier 30 may be reversed such that the thermal barrier 30 is located between the outer shell 26 and the moisture barrier 28, or various other orientations or configurations may be used.

In some cases, the garment 10 may include a face cloth (not shown) positioned as the innermost layer of the garment 10, located inside both the thermal barrier 30 and moisture barrier 28. The face cloth can provide a comfortable surface for the wearer and protect the thermal barrier 30 and/or moisture barrier 28 from abrasion and wear. The face cloth may be quilted to the adjacent layer (i.e. the thermal barrier 30 in the illustrated embodiment), and in some cases can be considered to be part of the thermal barrier 30. However, the face cloth is optional and may be excluded if desired. In addition, the garment 10 may not necessarily include the moisture barrier 28 and/or the thermal barrier 30 in certain cases.

In certain cases, the moisture barrier 28, thermal barrier 30 and face cloth can be permanently coupled together, such as by stitching, rivets, etc. In this manner the moisture barrier 28, thermal barrier 30 and face cloth define an inner liner 34 positioned inside the outer shell 26. The inner liner 34 can be removable from the outer shell 26, as show in in FIG. 2, such that the inner liner 34 and outer shell 26 can be separately cleaned and maintained, or used in conjunction with differing outer shells 26 and inner liners 34, respectively. In this case, the inner liner 34 may be removably attachable to the outer shell 26 by various means or mechanisms, including those outlined above for the fastener 20 which attaches the front panels 14, 16.

Each layer of the garment 10 disclosed herein, including the layers and components described above, as well as those described below, and the garment 10 as a whole, may meet the National Fire Protection Association ("NFPA") 1971 standards for protective firefighting garments ("Protective Clothing for Structural Firefighting"), which standards as of the filing date of this application are entirely incorporated by reference herein. The NFPA standards specify various minimum requirements for heat and flame resistance and tear strength. For example, in order to meet the NFPA standards, the outer shell 26, moisture barrier 28, thermal barrier 30 and face cloth must be able to resist igniting, burning, melting, dripping, separation, and/or shrinking more than 10% in any direction after being exposed to a temperature of 500° F. for at least five minutes. Furthermore, in order to meet the NFPA standards, the combined layers of the garment 10 must provide a thermal protective performance rating of at least thirty-five.

Alternately or in addition to the NFPA Standard 1971, the garment 10 disclosed herein may also meet European Norm ("EN") standards for firefighting garments set by the European Committee for Standardization (also known as Comité Européen de Normalisation ("CEN")). These standards include EN 469:2005 Level 1 and Level 2 certification. The EN standards for firefighter and protective garments in place as of the filing date of this application are entirely incorporated by reference herein.

In some cases, the thermal barrier 30 can have elastic or stretchable properties (the term "elastic" is used herein to encompass both terms). In particular, in one case the thermal barrier 30 has elasticity such that the thermal barrier 30, or parts thereof, can be stretched at least about 2% in one case, or at least about 5% in another case, or at least about 10% in another case, in the direction of applied stretching forces without breaking, and return to its original, undeformed shape/position when stretching forces are no longer applied. In addition, in some cases, the thermal barrier 30, or parts thereof, can have directional elastic properties such that the thermal barrier 30 has more elasticity in one direction (the stretch direction) in a plane of the material than any other direction of the thermal barrier 30. For example, in one case the stretchable portions of the thermal barrier 30 has at least 2×, or at least about 5×, or at least about 10× more elasticity in its stretch direction than in another direction, such as a direction that is perpendicular to the stretch direction. However, as will be described in greater detail below, in some cases the stretchable material/patches of the thermal barrier can also be made of material that has a multi-directional stretch; i.e. is equally stretchable, or somewhat equally stretchable, in various directions, in the elongation percentages outlined above.

Figure 2:
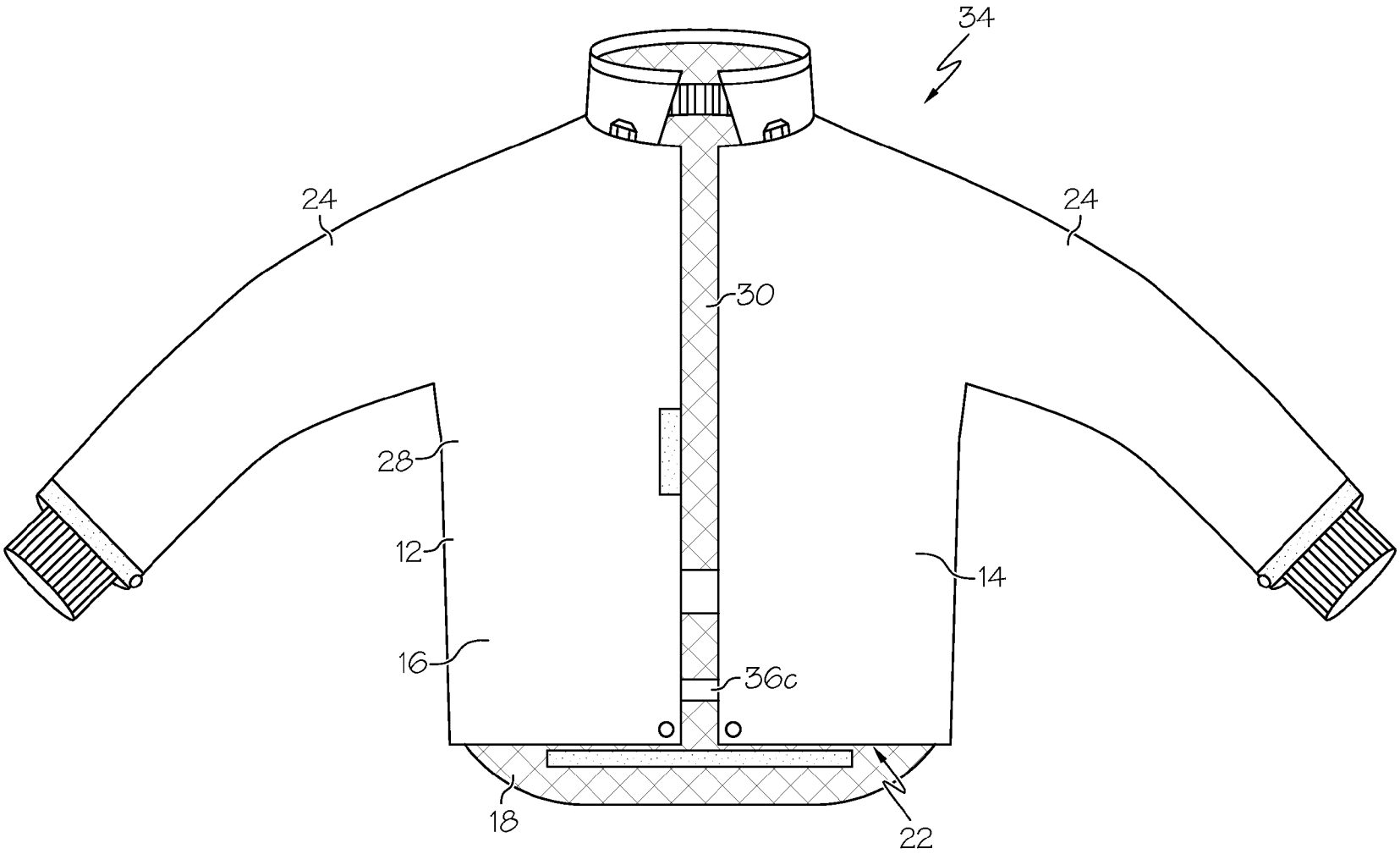
FIG. 2 is a front view of a liner of the garment of FIG. 1.
Figure 3:
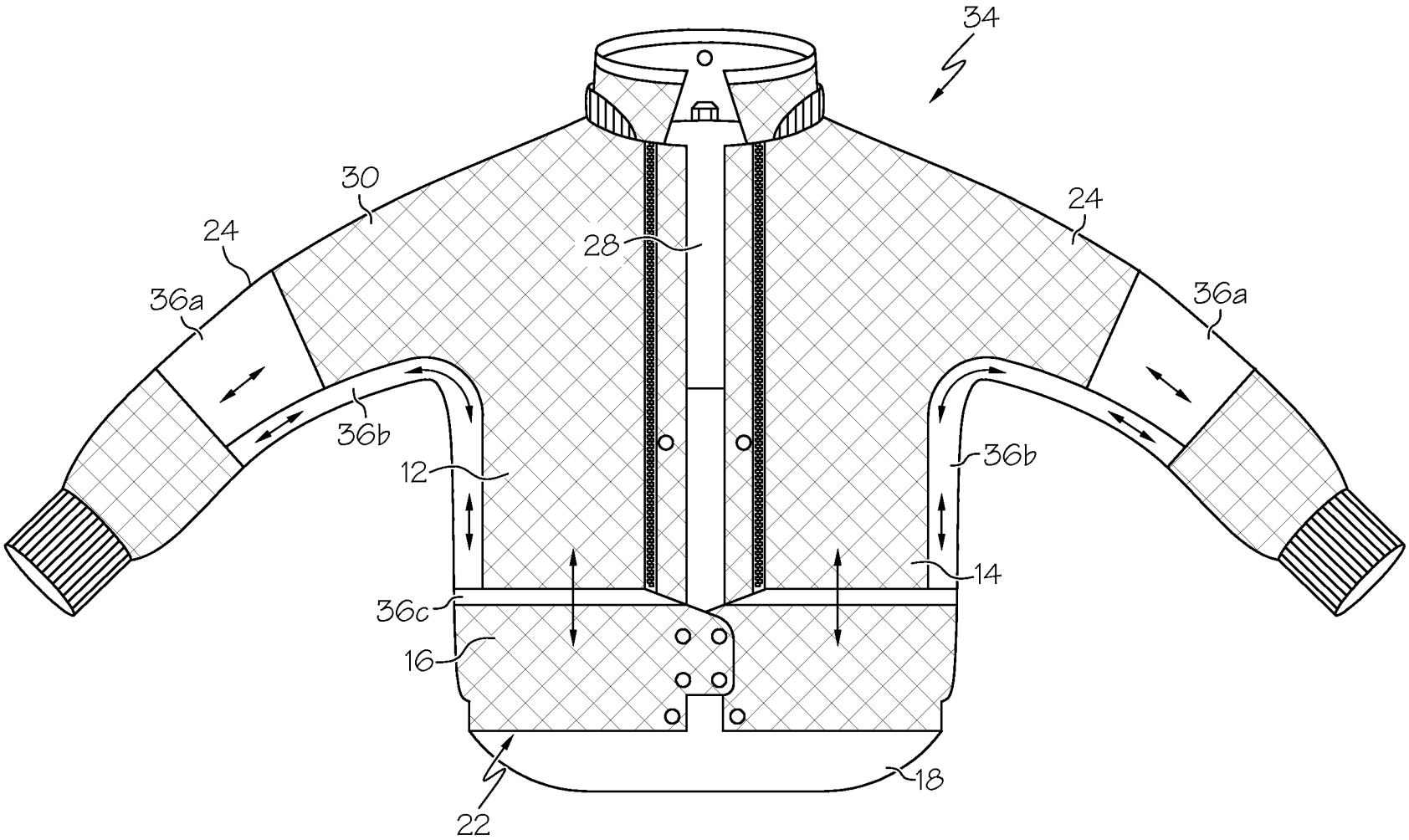
FIG. 3 is a front view of the liner of FIG. 2, turned inside-out.
Figure 4:
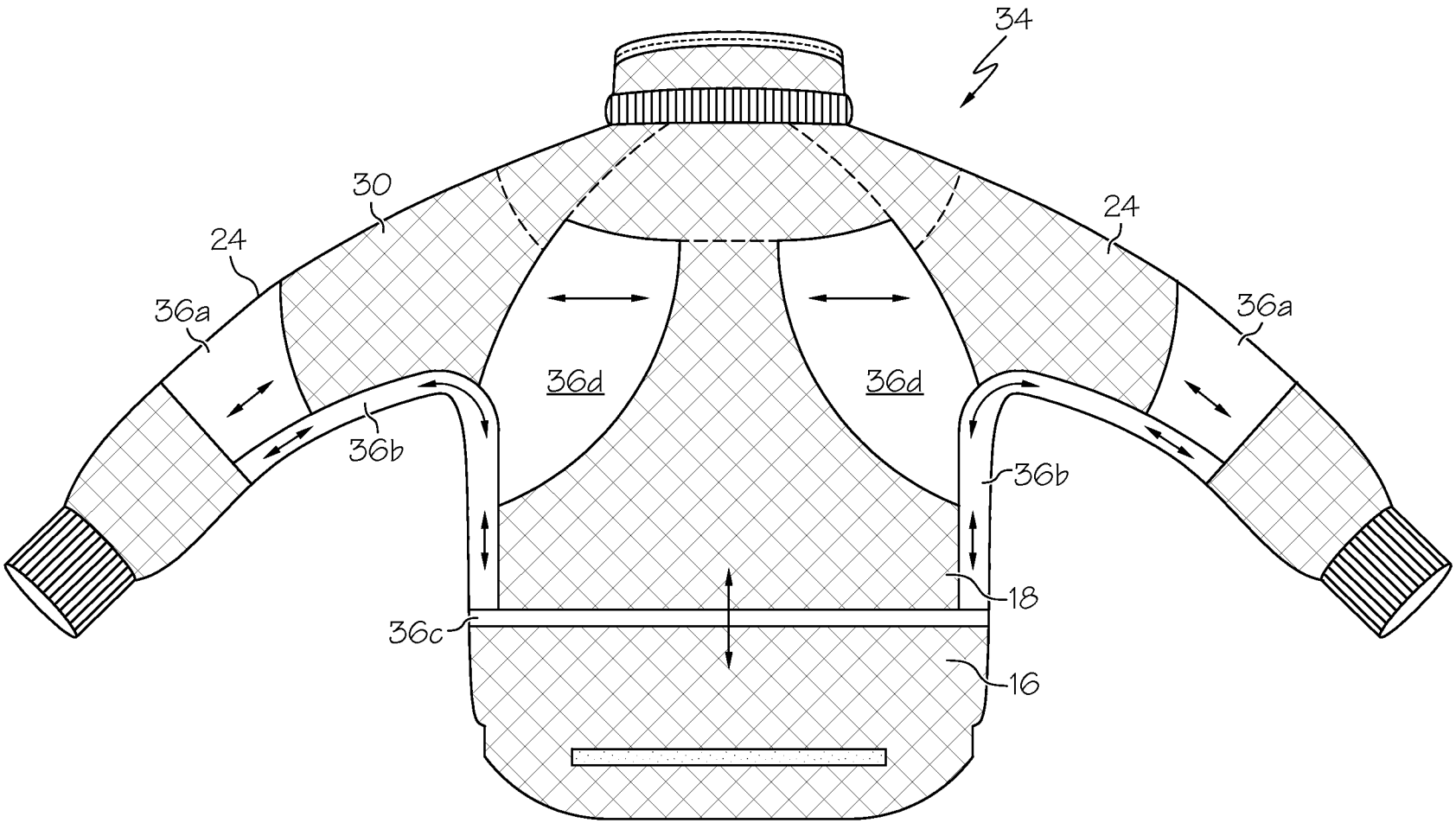
FIG. 4 is a back view of the liner of FIG. 3.

FIG. 2 shows the inner liner 34 removed from the outer shell 12 and FIGS. 3 and 4 show front and back views, respectively, of the inner liner 34 turned inside-out. As can be seen in one case the thermal barrier 30 includes discrete patches, areas or portions 36 that are elastic or stretchable, and optionally have directional stretch properties. In one case the remainder of the thermal barrier 30 is made of material that is not elastic and/or does not have directional stretch properties, although the remainder of the thermal barrier 30 could also be made of generally elastic material. The patches 36 can be co-planar/aligned with the other (non-stretchable) portions of the thermal barrier 30 such that the stretchable and non-stretchable portions form a continuous integral thermal barrier 30/layer.

The patches 36 of stretch material can be oriented such that their directional stretch properties provide ease of movement to a wearer. For example, as shown in FIGS. 3 and 4, in one case the thermal barrier 30 includes a patch of directional stretch material **36*a* about each elbow of the thermal barrier 30. In the illustrated embodiment the elbow patches 36*a* extend three hundred and sixty degrees about the sleeves 24 and extend at least about one-two inches both above and below the elbow joint of the coat 10/thermal barrier 30**/wearer.

When the patches **36*a* are made of a material with directional stretch qualities, the patches 36*a* can be oriented such that their stretch direction extends along the length of the sleeves 24, as shown by the arrows in FIGS. 3 and 4. In this manner, the patches 36*a* can stretch and expand when a wearer bends his or her elbow, and the patches 36*a*** returns to their original shape when the elbow is no longer bent.

The elasticity provided by the patches **36*a* reduces stress upon the wearer such that the wearer expends less energy in arm movements, including repetitive tasks such as walking or running, winding up hoses or cords, climbing ladders, etc. In particular, the energy required to elastically stretch the patches 36*a* can be less than the energy required to shift position of part of the coat 10** as it slides across the wearer's body, in a garment lacking elastic patches. This increased ease of movement and conservation of energy can be critical over time and in extreme conditions, helping wearers to retainer their energy and remain mentally sharp. These benefits also apply to the other elastic patches described below.

The thermal barrier 30 can also incorporate relatively thin, elongated side patches **36*b* of stretch material which are positioned on the side of the thermal barrier 30/coat 10/wearer (i.e. extending between the front and back of the garment 10), positioned below an elbow patch 36*a*, on the underarm of an associated sleeve 24, extend down the underside of the sleeve 24, and terminating around the waist of the coat 10/thermal barrier 30/wearer. If made of a material having directional stretch qualities, the side patches 36***b* can be oriented such that the stretch direction extends along the length of the patches 36*b*, as shown by the arrows in FIGS. 3 and 4.

The side patches 36*b* help to provide elasticity/flexibility when the wearer moves his or her arms, particularly when arms are moved at the shoulder, and more particularly when the wearer raises his or her arms above the shoulder or head, or bends at the waist. In particular, when a wearer raises his or her arms in this manner, the side patches 36*b* stretch along their length, as shown by the associated arrows indicating stretch direction, providing ease of movement to the wearer. The patches 36*b* also reduce hem-rise in the coat 10 when the wearer raises his or her arms, helping to ensure that the wearer's midsection is not exposed when the wearer's arms are raised.

The thermal barrier 30 can also incorporate a relatively thin, elongated lower patch 36*c* of stretch material which is positioned along the bottom of the coat 10, adjacent to the waist of the coat 10/thermal barrier 30/wearer and the bottom end of the side patches 36*b*. In the illustrated embodiment the bottom patch 36*c* extends at least about two hundred and seventy degrees about the perimeter of the coat 10, or about three hundred and sixty degrees about the waist of the coat/wearer when the garment 10 is worn. However the patch 36*c* can extend less than entirely around the waist, if desired. As can be seen, if the patch 36*c* has directional stretch qualities, the patch 36*c* can be oriented such that its direction of stretch is oriented generally vertically, parallel to a sagittal plane of the coat 10/wearer. The lower patch 36*c* is oriented to provide stretch/elasticity when a wearer raises his or her arms and/or bends at the waist, providing benefits similar to those provided by the side patches 36*b* outlined above, but spaced around the perimeter of the coat 10.

As shown in FIG. 4 the thermal barrier 30 can also incorporate shoulder patches 36*d* on back of the coat 10/thermal barrier 30/wearer, each shoulder patch 36*d* being positioned adjacent to the shoulder of the garment 10/thermal barrier 30/wearer. In the illustrated embodiment each shoulder patch 36*d* extends above the underarm of the garment 10 down to about the midpoint of the side. If they shoulder patches 36*d* have a directional stretch property, the shoulder patches 36*d* can be oriented such that their direction of stretch is oriented generally horizontally, perpendicular to a sagittal plane of the coat 10/wearer (parallel to a transverse plane). The shoulder patches 36*d* are oriented such that the patches 36*d* provide stretch/elasticity when a wearer moves his or her arms forwardly, or leans forward, or provides other similar motion.

The various patches 36*a*, 36*b*, 36*c*, 36*d* cooperate to provide a thermal barrier 30 which provides comfort and thermal protection to the wearer, while providing ease of use and lessening the exertion required by the wearer during activity. In addition, the patches 36*a*, 36*b*, 36*c*, 36*d* work in combination to provide increased benefit to the wearer. For example, a wearer typically does not perform only a single type of motion, but instead undertakes various types of motion in series, or simultaneously, or carries out hybrid movements. The patches 36*a*, 36*b*, 36*c*, 36*d* are shaped and located to accommodate a wide range of such partial or hybrid motions.

In addition, by having various patches 36*a*, 36*b*, 36*c*, 36*d* with stretch directions that are not parallel or not aligned, the patches 36*a*, 36*b*, 36*c*, 36*d* can accommodate differing types of motion which necessarily apply stresses in differing directions to the thermal barrier 30. Moreover, even a "single" movement, such as reaching one's arms forward, will typically involve raising of the arms (accommodated by side patches 36*b* and bottom patch 36*c*), moving the arms forward (accommodated by shoulder patches 36*d*), and often a bending of the elbows (accommodated by elbow patches 36*a*). Thus, the various patches 36*a*, 36*b*, 36*c*, 36*d* are positioned at strategic locations, oriented and configured to accommodate certain movements of the wearer.

The location and orientation of the patches 36*a*, 36*b*, 36*c*, 36*d*, and their borders relative to each other and relative to the other or non-stretch portion of the thermal barrier 30, can be selected to provide maximum benefit to the wearer to accommodate a range of movement activities. The areas of the thermal barrier 30 without stretch material may experience relatively low stretch forces, and therefore may not be made of directional stretch material to provide a cost savings, avoid inadvertent stretching of the thermal barrier 30, and ensure stretching is applied where desired (i.e. at the patches 36*a*, 36*b*, 36*c*, 36*d*). Each patch 36*a*, 36*b*, 36*c*, 36*d* may be made of a separate and discrete piece of material, coupled to other portions of the thermal barrier 30 by stitching, adhesives, etc.

Figure 5:
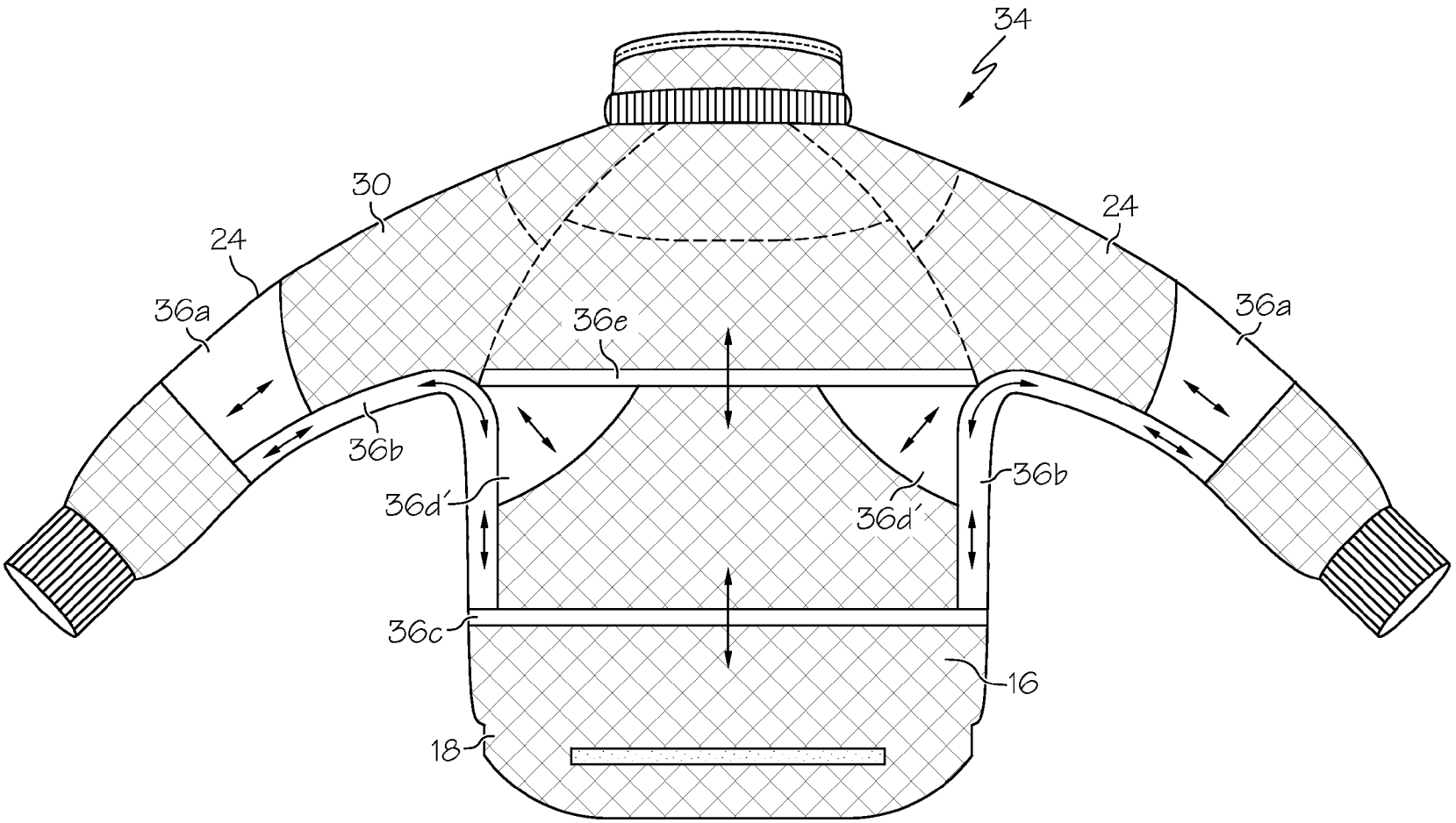
FIG. 5 is a back view of an alternate liner turned inside-out.

FIG. 5 illustrates an alternate embodiment in which the patches 36*a*, 36*b*, 36*c*, 36*d* have the same shape and configuration as shown in the embodiment of FIGS. 3 and 4, but the shoulder patches 36*d'* are reduced in size compared to those of FIG. 4 such that the shoulder patches 36*d'* generally do not extend above the underarm/patches. In addition, the alternate shoulder patches 36*d'* are oriented such that their direction of stretch (if they have one) is at an angle (between about 30 and about 60 degrees, in one case, and more specifically about 45 degrees in the illustrated case) relative to a vertical axis/sagittal plane. This orientation helps the patches 36*d'* to accommodate a wider range of movement of the wearer, and can also help to prevent hem rise of the coat 10. However, if desired, the patches 36*d'* can have generally horizontally oriented direction of stretch, similar to patches shown in FIG. 4; conversely, the patches 36*d* of FIG. 4 can have an angled direction of stretch such as that shown in FIG. 5.

In addition, the embodiment of FIG. 5 includes a relatively thin, elongated upper patch 36*e* of stretch material positioned immediately above and adjacent to the shoulder patches 36*d'*, and extends across the back of the thermal barrier 30, or generally the entire width of the back. As can be seen, the upper patch 36*e* can be oriented such that, if it is made of a directional stretch material, the direction of stretch is oriented generally vertically, parallel to a sagittal plane of the coat 10/wearer. The patch 36*e* is oriented such that the patch 36*e* provides stretch/elasticity when a wearer raises his or her arms, and/or bends at the waist, similar to the benefits provided by the lower patch 36*c*.

Due to the angled direction of stretch of the shoulder patches 36*d'*, and the inclusion of the upper patch 36*e*, the configuration shown in FIG. 5 can be particularly useful in addressing movement wherein the wearer raises his or her arms. However, it should be understood that the various patches 36*a*, 36*b*, 36*c*, 36*d*, 36*e* disclosed herein can be used in nearly any combination. For example, the thermal barrier 30 is shown herein as including various patches 36*a*, 36*b*, 36*c*, 36*d*, 36*e* in differing configurations and orientation. However, it should be understood that the garment 10 can include the patches 36*a*, 36*b*, 36*c*, 36*d*, 36*e* in various combinations, and various ones of the patches 36*a*, 36*b*, 36*c*, 36*d*, 36*e* need not be included in the thermal barrier 30. In addition, additional patches beyond those explicitly shown herein can be utilized. Finally, the patches 36*a*, 36*b*, 36*c*, 36*d*, 36*e* can have differing configurations from those shown herein, can be discontinuous, have differing sizes, and incorporate other variations. However, in one case, at least two patches are utilized, wherein the patches have non-aligned or non-parallel stretch direction, and in one case the patches are not symmetrical relative to a vertical or sagittal plane of the coat 10/wearer, to provide the various benefits outlined above, such as accommodating various types of motion.

In one embodiment, the directional stretch material/patches are made of or include a three end fleece material, such as that sold by Southern Mills, Inc. (d/b/a Tencate Protective Fabrics USA) of Union City, Ga. In one case, the three end fleece includes stitch yarns, tie yarns and nap yarns. The nap yarns extend in generally straight lines, and the stitch yarns and tie yarns may be formed in a generally looped or coiled shape, with the loops being perpendicular to the nap yarns. The stitch yarns and tie yarns overlie each other and follow generally the same path to form a knitted face layer. The nap yarns extend across the back of the stitch yarns and tie yarns, except that the nap yarns are tied to the tie yarns are periodic locations, such as at about every fourth wale or column of the tie yarns.

The three-end fabric can be two sided fabric with a face side and a back side. The back side of the fabric can be subjected to napping or fraying which pulls the nap yarns away from the knit, forming a fleece that increases the thermal insulation of the material and may face away from the wearer. After napping, the material can be exposed to elevated temperature, in an oven or the like, to heatset and stabilize the material.

The three-end knitted fabric may have increased stretch/elasticity. The three end knitted fabric can have increased stretch/elasticity in a direction generally perpendicular to the nap yarns. In particular, since the stitch yarns and tie yarn are somewhat looped or coiled, the stitch yarns and tie yarns can be pull from a slack state to a taut state, which movement lends stretchability/elasticity to the material. Thus, the stretchability/elasticity of the material can be the result of the construction of the material, and not necessarily due to elasticity of any particular fibers. Further details relating to a particular three end fleece can be found in U.S. Pat. No. 5,727,401 to Statham et al., the entire contents of which are incorporated by reference herein.

The directional stretch material/patches can be made of other materials, such as a two end fleece. In the case of a two end fleece, there are no separate tie yarns, and the stitch yarns are instead periodically tied to the nap yarns. The two end fleece can be brushed on both sides, or only one side. The directional stretch material/patches can also be made of other fabrics, such as a non-fleeced material, or multiple layers of other knitted material, such as jersey, rib or interlock knit material with mechanical stretch, or materials made of or incorporating elastic fibers, in one case.

The stretch materials/patches can be made of any of a variety of fire resistant materials, including those outlined above for the thermal barrier material, and also including a fire resistant NOMEX/viscose blend. As noted above, the stretch materials/patches may gain their flexible/stretchable qualities from the assembly/construction (collectively termed "construction" herein) of the materials—e.g. in one case coiled fibers that can be pulled taut. It may be desired that the material of the stretch patches gain their elasticity from the construction of the materials, and not from any elastic fibers that are woven or incorporated into the material. In particular, fibers that are sufficiently inherently elastic (including but not limited to elastomers or rubberlike polymers) can lose their elasticity after exposure to heat. Thus, the stretch material/patches may instead seek to avoid the use of elastic fibers, and in one case may lack any elastic fibers, or significant elastic fibers (in one case, may have less than 1% by weight of elastic/elastomeric fibers), which may be fibers that can be stretched at least about 2% in one case, or at least about 5% in another case, or at least about 10% in another case, in the direction of applied stretching forces without breaking, and return to its original, undeformed shape/position when stretching forces are no longer applied.

As noted above, the patches can be made of directional stretch materials. When the patches are made of directional stretch material, the patches only expand in the direction of need and/or stretching can be more controlled. Directional stretch material can also limit that portion of the thermal barrier from over-expanding, which ensures that the directional stretch material retains its thermal insulation capabilities. Moreover, since directional stretch material limits the overall stretching of the material, the material/patches may not become as loose over time as non-directional stretch material. It may also be easier to manufacture elastic material, that gains its elasticity from the construction of the material, having a directional stretch component. However, as noted above, it is not required that the material/panels/patches/thermal liner be made of a directional stretch material. In some cases, the material/patches/panels/thermal liner can be made of a multi-directional stretch material, including materials that are elastic/stretchable in two perpendicular directions and/or all directions.

The directional stretch patches can also be applied to a thermal barrier in other garments besides coats, including one-piece jump suits or body suits, vests, trousers, hoods, etc. The directional stretch patches can be positioned in areas that experience stress/stretching forces during use. For example, in the case of trousers, patches of directional stretch material can be used around the knees of the garment, in a manner analogous to the elbow patches 36*a* described and shown herein. Patches of directional stretch material can also be positioned at the outside hip areas of the garment, in the crotch, across the seat, or at other positions.

Having described the invention in detail and by reference to certain embodiments, it will be apparent that modifications and variations thereof are possible without departing from the scope of the invention.

What is claimed is:

1. A protective garment comprising:

an outer shell made of at least one of a flame, heat or abrasion resistant material or combinations thereof; and a thermal barrier positioned inside said outer shell such that said thermal barrier is configured to be positioned between said outer shell and a wearer when said garment is worn, wherein said thermal barrier has a thermal protection performance of at least about twenty and includes at least two areas of elastic material, each elastic area having directional stretch qualities such that each elastic area has greater elasticity in an associated particular direction in a plane of said associated elastic area compared to other directions in said plane, and wherein said particular directions for said at least two elastic areas are not parallel.

2. The garment of claim 1 wherein said at least two elastic areas are unsymmetrically positioned with respect to a sagittal plane of said garment.

3. The garment of claim 1 wherein each elastic area is stretchable by at least about 5% in the associated particular direction when stretching forces are applied, and is configured to return to an original position when stretching forces are no longer applied.

4. The garment of claim 1 wherein each elastic area is at least two times as stretchable in the associated particular direction compared to a direction that is perpendicular to the particular direction.

5. The garment of claim 1 wherein the elastic material has elasticity due to the construction of the material.

6. The garment of claim 5 wherein the elastic material includes a plurality of loops which are configured to generally reside in a loose condition and configured to be pulled taut when stretching forces are applied thereto and return to their loose conditions when stretching forces are no longer applied to provide the elasticity to the elastic material.

7. The garment of claim 5 wherein the elastic material lacks any elastic fibers.

8. The garment of claim 1 wherein said garment is in the form of a coat and wherein one of said elastic areas is positioned in an elbow area of a sleeve of the thermal barrier, and the associated particular direction is along a length of the associated sleeve.

9. The garment of claim 1 wherein said garment is in the form of a coat and wherein one of said elastic areas is positioned on a side of a torso portion of the thermal barrier and the underside of a sleeve, and the associated particular direction is along a length of the elastic area.

10. The garment of claim 1 wherein said garment is in the form of a coat and wherein one of said elastic areas is positioned at or adjacent to a back shoulder portion of the thermal barrier, and the associated particular direction is parallel to a transverse plane of the garment.

11. The garment of claim 1 wherein said garment is in the form of a coat and wherein one of said elastic areas is positioned at or adjacent to a back shoulder portion of the thermal barrier, and the associated particular direction is between about a thirty degree angle and about a sixty degree angle relative to a transverse plane of the garment.

12. The garment of claim 1 wherein said garment is in the form of a coat and wherein one of said elastic areas is positioned on a back portion of the thermal barrier and extends generally an entire width thereof, and the associated particular direction is parallel to a sagittal plane of the garment.

13. The garment of claim 12 wherein said one of said elastic areas is positioned adjacent to a waist area of the thermal barrier or adjacent to back shoulder area of the thermal barrier.

14. The garment of claim 1 wherein said garment is in the form of a coat and wherein one of said elastic areas is positioned in an elbow area of a sleeve, and the associated particular direction is along a length of the associated sleeve, and wherein the other of said elastic areas is positioned on a side of a torso portion of the thermal barrier and the underside of a sleeve, and the associated particular direction is along a length of the elastic area, the thermal barrier further including a first supplemental elastic area positioned at or adjacent to a back shoulder portion of the garment, and a second supplemental elastic area positioned on a back portion of the garment and extending generally an entire width thereof.

15. The garment of claim 1 wherein each elastic area is made of a separate and discrete piece of material.

16. The garment of claim 1 wherein said thermal barrier includes non-elastic areas coupled to said elastic areas.

17. The garment of claim 1 wherein the outer shell is made of an abrasion resistant material that resists igniting or burning or melting or dripping or separation when exposed to a temperature of 500° F. for five minutes.

18. The garment of claim 1 wherein each elastic area has a thermal protection performance of at least about twenty.

19. The garment of claim 1 wherein each elastic area resists igniting or burning or melting or dripping or separation when exposed to a temperature of 500° F. for five minutes.

20. The garment of claim 1 wherein further comprising a moisture barrier positioned inside said outer shell such that said moisture barrier is configured to be positioned between said outer shell and a wearer when said garment is worn, wherein said moisture barrier is made of a material that is generally liquid impermeable and generally moisture vapor permeable.

21. A protective garment comprising:

an outer shell in the form of a coat and made of at least one of a flame, heat or abrasion resistant material or combinations thereof; and a thermal barrier positioned inside said outer shell such that said thermal barrier is configured to be positioned between said outer shell and a wearer when said garment is worn, wherein said thermal barrier has a thermal protection performance of at least about twenty and includes a first elastic area positioned in an elbow area of a sleeve of the thermal barrier, a second elastic area positioned on a side of a torso portion of the thermal barrier and the underside of a sleeve, a third elastic area positioned at or adjacent to a back shoulder portion of the thermal barrier, and fourth elastic area positioned on a back portion of the thermal barrier and extending generally an entire width thereof.

22. The garment of claim 21 wherein each elastic area is made of a separate and discrete piece of material.

23. The garment of claim 21 wherein each elastic area has directional stretch qualities such that each elastic area has greater elasticity in an associated particular direction in a plane of said elastic area, and wherein said particular directions for at least two of said elastic areas are not parallel.

24. A protective garment comprising:

an outer shell made of at least one of a flame, heat or abrasion resistant material or combinations thereof; and a thermal barrier positioned inside said outer shell such that said thermal barrier is configured to be positioned between said outer shell and a wearer when said garment is worn, wherein said thermal barrier includes an area of elastic material and an area of non-elastic material, wherein the elastic material is elastic due to the construction of the material.

25. The garment of claim 24 wherein the elastic material includes a plurality of loops which are configured to generally reside in a loose condition and configured to be pulled taut when stretching forces are applied thereto to provide the elastic property to the elastic material.

26. The garment of claim 24 wherein the elastic material lacks any elastic fibers.

27. The garment of claim 24 wherein the elastic area generally has directional stretch qualities such that the elastic area generally has greater elasticity in a particular direction than in other directions.

28. The garment of claim 24 wherein the elastic area generally lacks directional stretch qualities such that the elastic area generally lacks greater elasticity in a particular direction than in other directions.

29. The garment of claim 24 wherein said thermal barrier includes a supplemental area of elastic material, each elastic area having directional stretch qualities such that each elastic area has greater elasticity in an associated particular direction than in other directions, and wherein said particular directions for the elastic area and the supplemental area are not parallel.

30. The garment of claim 24 wherein the area of elastic material and the area of non-elastic material are directly coupled together to form a continuous thermal barrier.

31. The garment of claim 24 wherein the garment is in the form of a coat and wherein said elastic area is positioned in an elbow area of a sleeve of the thermal barrier, or positioned on a side of a torso portion of the thermal barrier and the underside of a sleeve, or positioned at or adjacent to a back shoulder portion of the thermal barrier, or positioned on a back portion of the thermal barrier and extending generally an entire width thereof.

32. The garment of claim 1 wherein each elastic area has directional stretch qualities such that each elastic area has greater elasticity in the associated particular direction in the plane of said associated elastic area compared to all other directions in the plane of the associated elastic area.

* * * * *